US008276688B2

(12) United States Patent
Dietz et al.

(10) Patent No.: US 8,276,688 B2
(45) Date of Patent: Oct. 2, 2012

(54) DOWNHOLE CASING CUTTING TOOL

(75) Inventors: Wesley P. Dietz, Carrollton, TX (US); David J. Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 12/501,788

(22) Filed: Jul. 13, 2009

(65) Prior Publication Data

US 2011/0005755 A1 Jan. 13, 2011

(51) Int. Cl.
*E21B 49/02* (2006.01)

(52) U.S. Cl. ..... 175/78; 175/61; 175/79

(58) Field of Classification Search ..... 175/61, 175/73–83, 263, 258, 259, 323, 325.5, 424; 166/50

See application file for complete search history.

(56) References Cited

U.S. PATENT DOCUMENTS

| | | | | |
|---|---|---|---|---|
| 4,304,311 | A | 12/1981 | Shinn | |
| 4,350,204 | A * | 9/1982 | Horton | 166/175 |
| 4,449,595 | A * | 5/1984 | Holbert | 175/79 |
| 5,010,967 | A * | 4/1991 | Desai | 175/406 |
| 5,090,492 | A | 2/1992 | Keith | |
| 5,193,620 | A | 3/1993 | Braddick | |
| 5,445,222 | A * | 8/1995 | Pritchard et al. | 116/298 |
| 5,620,051 | A | 4/1997 | Carter et al. | |
| 5,699,866 | A * | 12/1997 | Cousins et al. | 175/78 |
| 6,116,344 | A | 9/2000 | Longbottom et al. | |
| 6,460,631 | B2 | 10/2002 | Dykstra et al. | |
| 6,766,859 | B2 * | 7/2004 | Haugen et al. | 166/313 |
| 7,178,609 | B2 * | 2/2007 | Hart et al. | 175/61 |
| 2002/0112894 | A1 * | 8/2002 | Caraway | 175/385 |
| 2005/0039905 | A1 | 2/2005 | Hart et al. | |
| 2008/0110678 | A1 * | 5/2008 | Radford et al. | 175/269 |
| 2009/0178799 | A1 * | 7/2009 | Shewchuk | 166/105.2 |

FOREIGN PATENT DOCUMENTS

| | | | |
|---|---|---|---|
| EP | 1811124 | A1 | 7/2007 |
| WO | 2011008633 | A2 | 1/2011 |

OTHER PUBLICATIONS

"People and Companies," Drilling Contractor, http://www.iadc.org/dcpi/dc-mayjun06/May06-people.pdf, May/Jun. 2006, pp. 75-76, International Association of Drilling Contractors (IADC).

"QuickCut Casing Exit System 'A Cut Above'," http://www.weatherford.com/weatherford/groups/public/documents/general/wft006036.pdf (last visited Feb. 3, 2009), Weatherford.

"Security DBS Drill Bits HyperSteer and FullDrift Bits for Rotary Steerable Applications for Performance Way Beyond Traditional PDC Limits," Drilling and Formation Evaluation, Jan. 2006, Halliburton, U.S.A.

(Continued)

*Primary Examiner* — Kenneth L Thompson
*Assistant Examiner* — Yong-Suk Ro
(74) *Attorney, Agent, or Firm* — Conley Rose, P.C.

(57) ABSTRACT

An oilfield downhole cutting tool comprises a tool body that comprises a non-cutting stabilizing section. The cutting tool further comprises a plurality of cutters coupled to the tool body forward of the non-cutting stabilizing section, wherein a maximum cutting diameter defined by the cutters is less than 1.1 times a diameter defined by the non-cutting stabilizing section. The cutting tool further comprises a cutting rate limiting component coupled to the tool body.

20 Claims, 7 Drawing Sheets

OTHER PUBLICATIONS

"Special Tools-Concept Section," http://www.alliedmachine.com/productinfo/specialprod1.cfm (last visited Jan. 27, 2011), Allied Machine & Engineering Corp.

Foreign Communication From a Related Counterpart Application—International Search Report and Written Opinion, PCT/US2010/041407, Feb. 15, 2011.

* cited by examiner

DOWNHOLE CASING CUTTING TOOL

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wells may comprise a plurality of wellbores. For example, a main wellbore may be drilled, and one or more branch wellbores may be drilled off of the main wellbore. The branch wellbores may be referred to in some contexts as lateral wellbores. Wells comprising at least one lateral wellbore may be referred to in some contexts as multilateral wells. The main wellbore may be drilled and cased. A window may then be cut in the casing at a suitable location for initiating drilling a lateral wellbore off of the main wellbore. It is common to place a whipstock proximate to the desired window and to rotate a cutting tool at the end of a work string so as to cut through the casing to form the desired window in the casing. The whipstock redirects the cutting tool against the casing to cuttingly engage the wall of the casing. After the window is cut in the casing, the cutting tool is withdrawn from the wellbore and drilling tools are run into the wellbore and directed through the window by the whipstock which may remain in place until the completion of the subject lateral wellbore.

SUMMARY

In an embodiment, an oilfield downhole cutting tool is disclosed. The cutting tool comprises a tool body that comprises a non-cutting stabilizing section. The cutting tool further comprises a plurality of first cutters coupled to the tool body forward of the non-cutting stabilizing section of the tool body, wherein a maximum cutting diameter defined by the first cutters is less than 1.1 times a diameter defined by the non-cutting stabilization section of the tool body. In an embodiment, the cutting tool further comprises a cutting rate limiting component coupled to the tool body. In an embodiment, the maximum cutting diameter defined by the first cutters is less than 1.02 times the diameter defined by the non-cutting stabilizing section of the tool body. In an embodiment, the tool body comprises a helical flute. In an embodiment, the tool body comprises two helical flutes. In an embodiment, the first cutters are removeably coupled to the tool body. In an embodiment, the cutting tool further comprises a plurality of second cutters located aft of the non-cutting stabilizing section of the tool body. In an embodiment, the first cutters comprise a spade cutter removeably coupled to the tool body surmounting a forward end of the tool body. In an embodiment, the first cutters are comprised of tungsten carbide. In an embodiment, the first cutters comprise a plurality of backup cutters. In an embodiment, the cutting tool further comprises a plurality of bearing pads removeably coupled to the non-cutting stabilizing section of the tool body. In an embodiment, at least a portion of the non-cutting stabilizing section of the tool body is provided with hardbanding. In an embodiment, at least a portion of the non-cutting stabilizing section of the tool body is surface hardened. In an embodiment, the tool body defines an interior cavity and defines a port proximate to a cutting edge of one of the first cutters, the port communicating with the interior cavity. In an embodiment, the tool body further defines ports proximate to a cutting edge of each of the first cutters, the ports communicating with the interior cavity. In an embodiment, the cutting tool defines a step cutter. In an embodiment, the non-cutting stabilizing section of the tool body radially stabilizes the cutting tool in 360 degrees.

In another embodiment, an oilfield downhole cutting tool system is disclosed. The cutting tool system comprises a cutting tool comprising a tool body comprising a non-cutting stabilizing section and a plurality of cutters coupled to the tool body. The cutting tool system further comprises a bushing defining a cavity into which at least a portion of the cutting tool is received in a run-in state of the system. In an embodiment, the bushing defines a cutting trajectory of the cutting tool. In an embodiment, the bushing radially stabilizes the cutting tool in 360 degrees during initial cutting operation. In an embodiment, the bushing radially stabilizes the cutting tool via contact with the non-cutting stabilizing section of the cutting tool. In an embodiment, the cutting tool partially cuts out the bushing during cutting operation. In an embodiment, the bushing is coupled to the cutting tool by one of a shear pin and a retainer engaged in corresponding retainer recesses in each of the cutting tool and the bushing during run-in. In an embodiment, the bushing serves to guide tools through a window cut by the cutting tool in a casing of a wellbore, after removal of the cutting tool from the wellbore. In an embodiment, the bushing comprises a plurality of embedded tungsten carbide pads outside of the cutting trajectory of the cutting tool. In an embodiment, the bushing defines a slot to receive at least some of the cutters when decoupling the cutting tool from the bushing.

In another embodiment, a method of cutting a hole in a wellbore casing is disclosed. The method comprises running a cutting tool system into a wellbore, the cutting tool system comprising a cutting tool coupled to a bushing, the cutting tool received by a cavity defined by the bushing. The method also comprises rotating the cutting tool to cut through the busing and to cut the hole through the casing, the cutting following a trajectory determined by the cavity. In an embodiment, the method further comprises detaching a cutter of the cutting tool, one or rotating and flipping the cutter, and reattaching the cutter to the cutting tool. In an embodiment, the method further comprises the bushing radially stabilizing the cutting tool in 360 degrees during at least an initial portion of the cutting. In an embodiment, the clearance between the bushing and a non-cutting stabilizing portion of the cutting tool is less than about 20 thousandths of an inch (0.020 inches) in a run-in state of the cutting tool system. In an embodiment, the method further comprises the cutting tool automatically limiting the rate of cutting through the bushing. In an embodiment, the method further comprises removing the cutting tool from the wellbore while leaving the bushing in the wellbore and the bushing guiding a completion tool through the hole in the wellbore casing. In an embodiment, the cutting tool cuts with both a drilling action and a milling action. In an embodiment, the method further comprises applying force on the cutting tool to decouple the cutting tool from the bushing. In an embodiment, the method further comprises catching the cutting tool on a shoulder of the bushing and receiving at least some of a plurality of cutters coupled to the cutting tool into a slot defined by the bushing.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
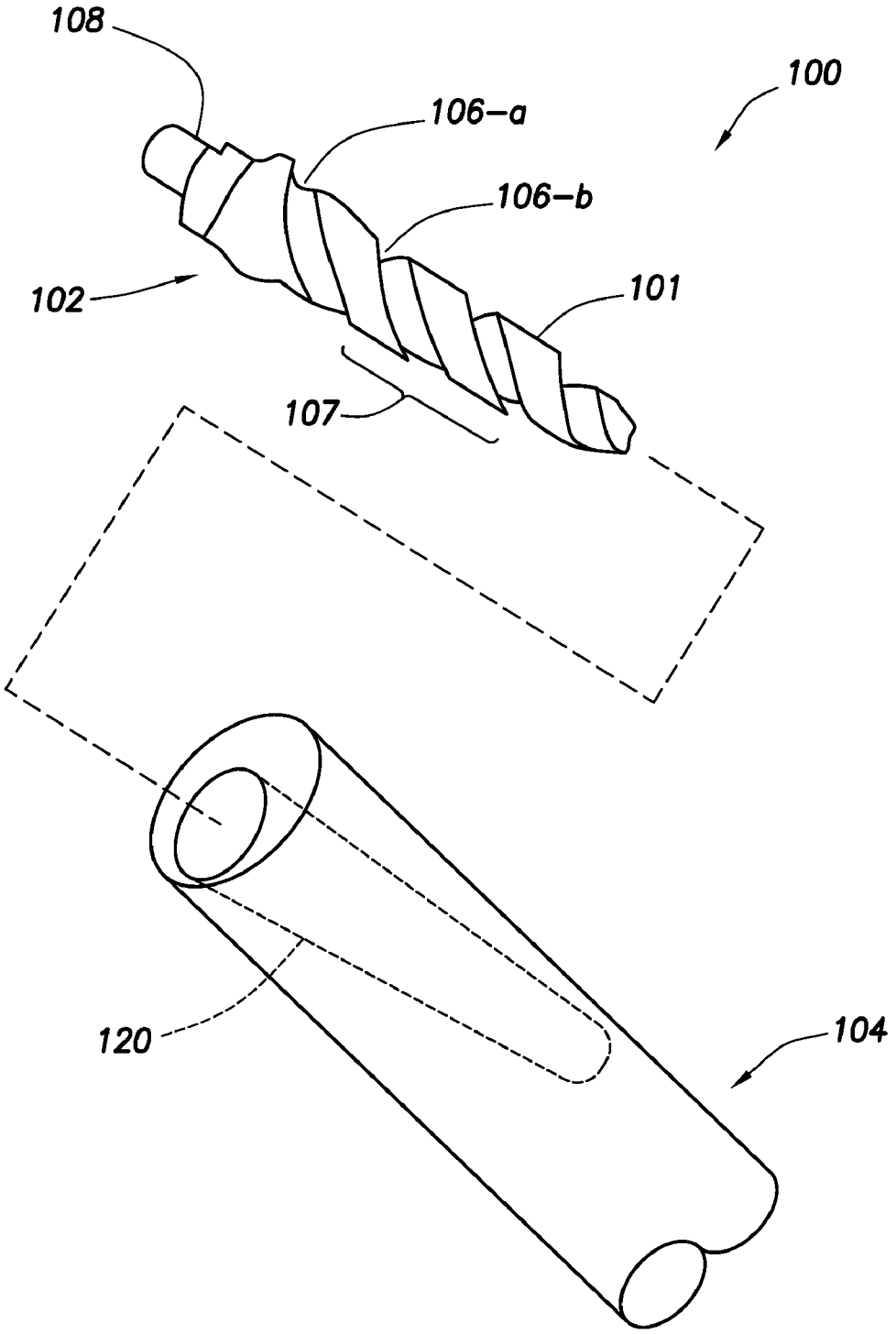
FIG. 1A illustrates a first view of a downhole cutting tool system according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Prior art tool systems for cutting windows in wellbore casing may have several shortcomings. A representative cutting tool comprises a metallic body having helical flutes to promote evacuation of cuttings. Cutter elements may be braised on high points or lands of the cutting tool by craftsmen. The cutter elements typically are not precisely positioned and hence are not optimally oriented for cutting efficiently. The braising process is time consuming and hence relatively expensive. The process for refurbishing a worn cutting tool, similarly, is time consuming and relatively expensive. Typically, refurbishment of the worn cutting tool takes place in a shop where specialized tools are available for carrying out the refurbishment procedures. For example, the process may include melting off the worn cutter elements and braising on new cutter elements.

The process for operating the representative cutting tool to cut a window in wellbore casing may involve setting a whipstock in the casing at the appropriate location and running-in the cutting tool on the end of a work string, such as a string of pipe joints. While turning the cutting tool, the weight of the work string drives the cutting tool into the whipstock which partially redirects the force on the cutting tool against the wall of the casing. The cutting tool cuts the casing but also cuts the whipstock undesirably. The undesired cutting into the whipstock prematurely wears the cutters braised onto the cutting tool. The prior art whipstock may not adequately stabilize the cutting tool, and consequently the cutting tool may rotate and walk uncontrolled in the wellbore, subjecting the cutters to a variety of undesirable forces such as impact forces and non-compression forces that may damage the cutters. The lack of stabilization of the cutting tool also may result in less efficient cutting and hence more time consumed by the operation of cutting the window in the casing. Additionally, the inadequately stabilized cutting typically results in an irregularly shaped window in the casing, for example a banana shaped window, which makes subsequent run-in of tools through the window to work in the lateral wellbore more difficult.

The cutting tool system taught by the present disclosure addresses some of the shortcomings of the prior art. In an embodiment, a cutting tool system comprising a bushing and a cutting tool that is at least partially enclosed by a cavity defined by the bushing is run into the wellbore and set in the casing string at a desirable location. The work string bears down on the cutting tool with force to shear a shear pin or a retainer coupling the cutting tool to the bushing to maintain proper alignment between the cutting tool and the bushing during run-in. The cutting tool is then turned by the work string to first cut through the bushing and then through the casing to create the desired regularly shaped window. In an embodiment, the cavity defined by the bushing may impart a desired cutting trajectory to the cutting tool that the cutting tool continues to follow as it cuts through the bushing, through the casing string to form the window, and into a formation proximate to the window. While the cutting tool is cutting through the bushing, the cutting tool is stabilized by the bushing. Initially the cutting tool is stabilized and radially supported in 360 degrees by the bushing. As the cutting tool cuts through the bushing and into the casing wall, some of the radially supporting area of the bushing is cut away, but still much radial supporting area of the bushing remains. Additionally, as the cutting tool cuts through the bushing, the casing, and the formation, the supporting area of the bushing may be considered to be replaced by supporting area of first the casing and later the formation. Additionally, a non-cutting stabilization section of the cutting tool stabilizes the cutting tool and discourages deviation of the cutting tool from its trajectory during cutting operation, for example by engaging with the bushing, the casing, and the formation. After the bushing has been cut out and the window in the casing has been completed, the bushing remains in the wellbore to guide and to direct tools subsequently run-in through the window to work in the lateral. When the lateral is completed, the bushing may be removed.

In an embodiment, a tool body of the cutting tool may have at least one helical flute for evacuation of cuttings and circulation fluid. In another embodiment, the tool body of the cutting tool may have two helical flutes for evacuation of cuttings and circulation fluid. In another embodiment, however, the tool body of the cutting tool may have at least one straight flute for evacuation of cuttings and circulation fluid. In another embodiment, the tool body of the cutting tool may not have a flute. In an embodiment, the cutters of the cutting tool are replaceably coupled to the cutting tool within recesses in the tool body at defined angles to promote efficient cutting of the casing. Alternatively, in another embodiment, the cutters of the cutting tool may be braised or welded to the tool body, making the cutters non-removable or not easily removable. In an embodiment, a cutting rate limiting component and/or feature may be provided to limit the cutting of the cutting tool to a rate effective to maintain the chip load on the cutters below a predefined load limit.

In an embodiment, the cutting tool defines an interior cavity and one or more ports, the interior cavity having communication with the ports. In an embodiment, the ports are located proximate to the cutting edges of each of the cutters wherethrough circulation fluid is distributed under pressure from the interior cavity of the cutting tool to both cool the cutting edge and promote breaking off cutting chips in a size effective to promote ready evacuation of cuttings first up the helical flutes and then up the wellbore to the surface. In an embodiment, when worn, the cutters may be first removed, rotated or flipped to present a fresh, unworn cutting edge, and then reattached to the cutting tool. In an embodiment, when all available cutting edges are worn beyond serviceability, the cutters may be retired from service and replaced. In an embodiment, the maintenance of cutters is a process that may be performed quickly by unskilled and/or semi-skilled workers in the field or in the shop. Similarly, in an embodiment, the bearing pads are easily and quickly replaced in the field or in the shop.

Figure 1B:
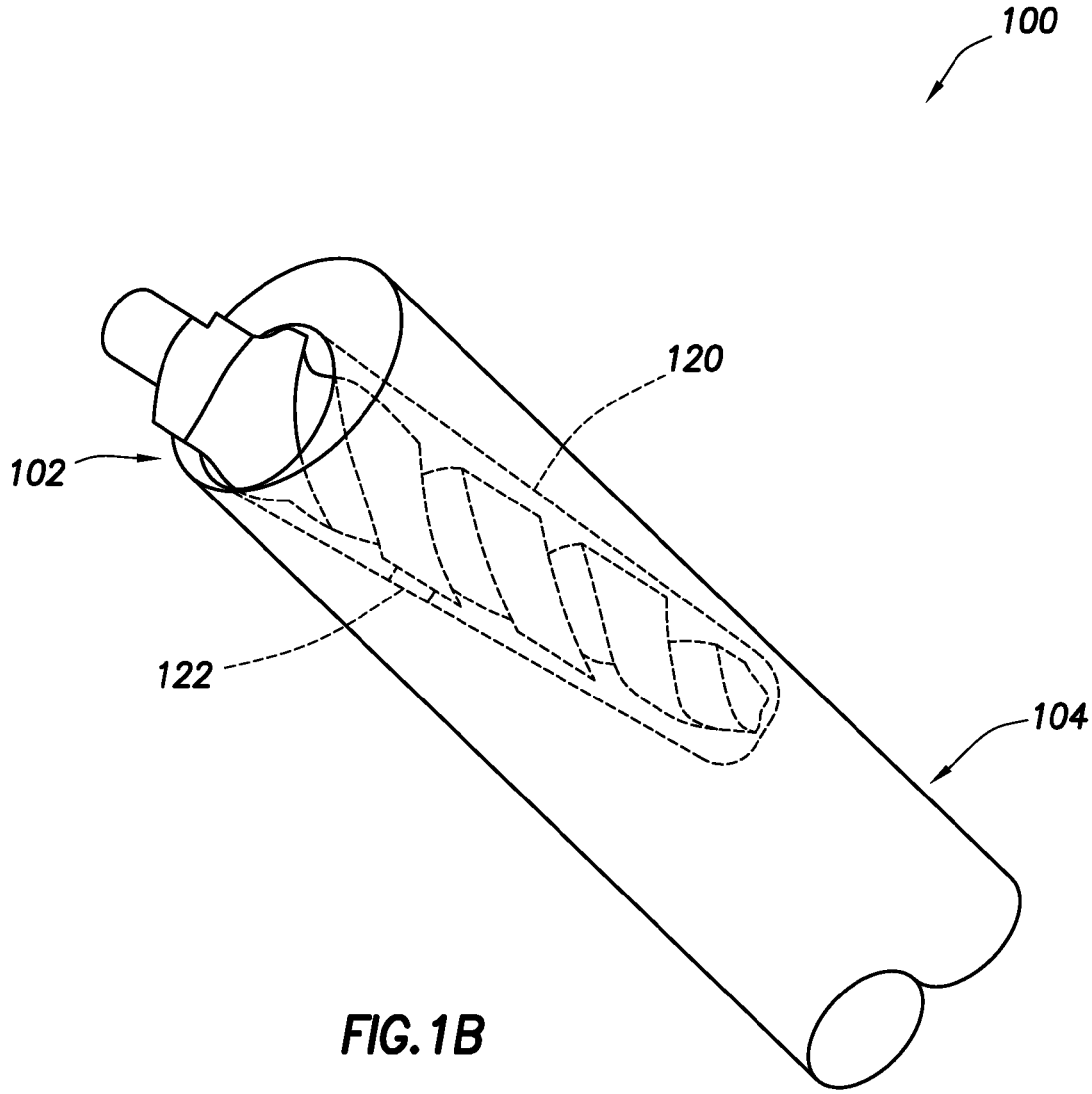
FIG. 1B illustrates a second view of the downhole cutting tool system according to an embodiment of the disclosure.

Turning now to FIG. 1A and FIG. 1B, an embodiment of a cutting tool system 100 is described. The cutting tool system 100 comprises a cutting tool 102 and a bushing 104. In an embodiment, the cutting tool 102 comprises a tool body 101 that defines a first helical flute 106-*a* and a second helical flute 106-*b*. In another embodiment, however, the tool body 101 may define only one helical flute 106 or greater than two helical flutes 106. In yet another embodiment, the tool body 101 may define one or more straight flutes. In yet another embodiment, the tool body 101 may not define a flute. A middle portion of the tool body 101 comprises a non-cutting stabilizing portion 107, which may also be referred to in some contexts as a non-cutting lateral supporting portion. The tool body 101 may further comprise a coupling 108 for coupling to a work string, for example a threaded portion. The bushing 102 defines a first cavity 120 that receives the cutting tool 102. In an embodiment, in run-in condition, the cutting tool 102 is coupled to the bushing 104 and secured in proper alignment with the bushing 104 by a shear pin 122. In another embodiment, in the run-in condition, the cutting tool 102 is coupled to the bushing 104 and secured in proper alignment with the bushing 104 by one or more retainers engaged by corresponding retainer recesses in each of the tool body 101 and the bushing 104. In another embodiment, spring loaded retainer pins and/or retainer rings may engage recesses in the cutting tool 102 and the bushing 104 to secure proper alignment when running in the cutting tool system 100 but release non-destructively in response to rotation. Alternatively, other known structures and mechanisms may be used to couple the cutting tool 102 to the bushing 104 in the run-in position.

Turning now to FIG. 2A, FIG. 2B, FIG. 2C, FIG. 2D, and FIG. 2E, further details of the cutting tool 102 are described. In an embodiment, the cutting tool 102 comprises a spade cutter 150 surmounting a for ward end of the tool body 101. In an embodiment, the spade cutter 150 may be removeably attached to the tool body 101, for example using screws, bolts, or other removable attachment hardware. In an embodiment, the spade cutter 150 is secured by attachment hardware at holes in the spade cutter 150 that are countersunk on the external faces. Alternatively, in another embodiment, the spade cutter 150 may be non-removeably attached to the tool body 101, for example the spade cutter 150 may be braised to the tool body 101 and not removable or not easily removable from the tool body 101. As used herein, non-removeably attached may mean that removal of the subject component may be difficult and may need to be performed in a shop environment where specialized equipment is available. The tool body 101 is machined to receive the spade cutter 150 and to provide structural support to the spade cutter 150 during cutting operations. In an embodiment, the spade cutter 150 may have a tungsten carbide composition, but in other embodiments the spade cutter 150 may be composed of some other rugged and durable material suitable to cutting operations.

In an embodiment, the cutting faces of the spade cutter 150 may each have a groove or other irregularity inwards from the cutting edge to promote predictable breaking off or chipping of the cutting and/or material removed from the bushing 104, the casing, and the formation proximate to the casing window as the cutting tool 102 works, where the chip has a size effective to promote ready evacuation of the cuttings from the cutting interface by circulation fluid. Cuttings that are too small may present insufficient surface area versus mass to be borne upwards readily by the flowing circulation fluid. Additionally, cuttings that form long continuous peels are susceptible to tangling with other cuttings and forming 'bird nests' that may jam the helical flutes 106 and/or the wellbore undesirably. In an embodiment, the spade cutter 150 is readily removed and replaced in the field or in the shop by unskilled and/or semi-skilled workers. In an embodiment, a port defined by the tool body 101 proximate to the spade cutter and having communication with an interior cavity of the tool body 101 provides circulation fluid under pressure during cutting operations to both cool the cutting edges of the spade cutter 150 and to promote breaking off cutting chips in a size effective to promote ready evacuation of cuttings. The width of the spade cutter 150 defines a cutting diameter of the spade cutter 150 as the cutting tool 102 rotates and works. In some contexts, the spade cutter 150 may be said to provide a drilling type of cutting functionality.

In another embodiment, the cutting tool 102 may be surmounted by other cutters. For example, in an embodiment, the cutting tool 102 may be surmounted by a solid drill. As another example, in an embodiment, the cutting tool 102 may be surmounted by two or more individual cutters and/or individual cutting inserts. In another embodiment, a different cutter may surmount the cutting tool 102.

In an embodiment, the cutting tool 102 further comprises a pair of first cutters 152-*a* and 152-*b*, located opposite each other across the longitudinal axis of the tool body 101. The cutters 152 may be supported in machined recesses in the face of the tool body 101 and may be removeably attached to the tool body 101, for example using screws, bolts, or other removable attachment hardware. In another embodiment, however, the cutters 152 may be non-removeably attached to the tool body 101, for example, braised to and/or spot welded the tool body 101 and non-removable or not easily removable from the tool body 101. The intersection of the shoulders of the machined recess may be drilled out to avoid the problem of machining a square corner at this position. In an embodiment, the first cutters 152 are secured by attachment hardware at holes in the first cutters 152 that are countersunk on the faces of the first cutters 152. In an embodiment, the cutting face of the first cutters 152 has a generally rectangular shape with distinctly rounded corners. In an embodiment, the first cutters 152 may have a tungsten carbide composition, but in other embodiments the first cutters 152 may be composed of some other rugged and durable material suitable to cutting operations. In an embodiment, the cutting face of the first cutters 152 may have irregularities that promote predictable breaking off or chipping of the cutting as the cutting tool 102 works, where the chip size has a size effective to promote ready evacuation of the cuttings from the cutting interface by circulation fluid.

The first cutters 152 may be positioned by the machined recesses to present only a limited portion of their edge as a cutting edge, for example by the machined recesses angling inwards towards a longitudinal axis of the tool body 101 at their aft ends. In an embodiment, the first cutters 152 may be positioned by the machined recesses to present less than about ⅓ of their edge as a cutting edge. Additionally, the first cutters 152 may be positioned by the machined recesses at an angle to face squarely into a helical direction of travel as the cutting tool 102 works. The machined recesses provide structural support to the first cutters 152 during cutting operations.

Figure 2A:
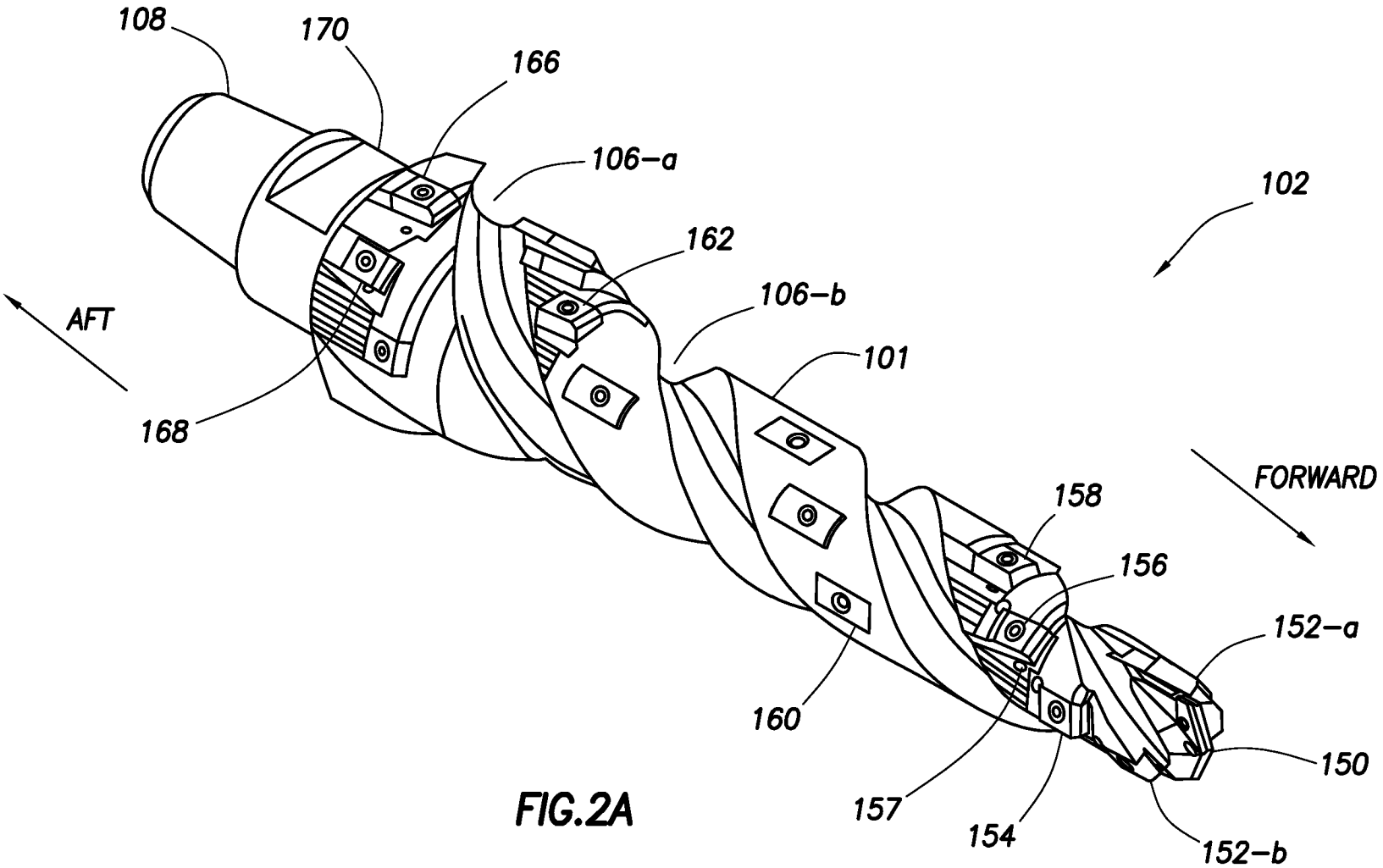
FIG. 2A illustrates a first view of a cutting tool according to an embodiment of the disclosure.
Figure 2B:
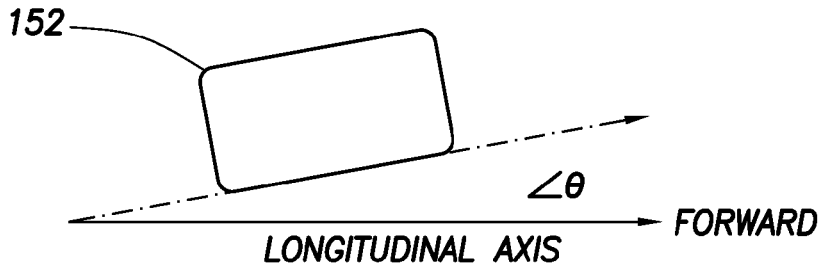
FIG. 2B illustrates a side view of a cutter position according to an embodiment of the disclosure.
Figure 2C:
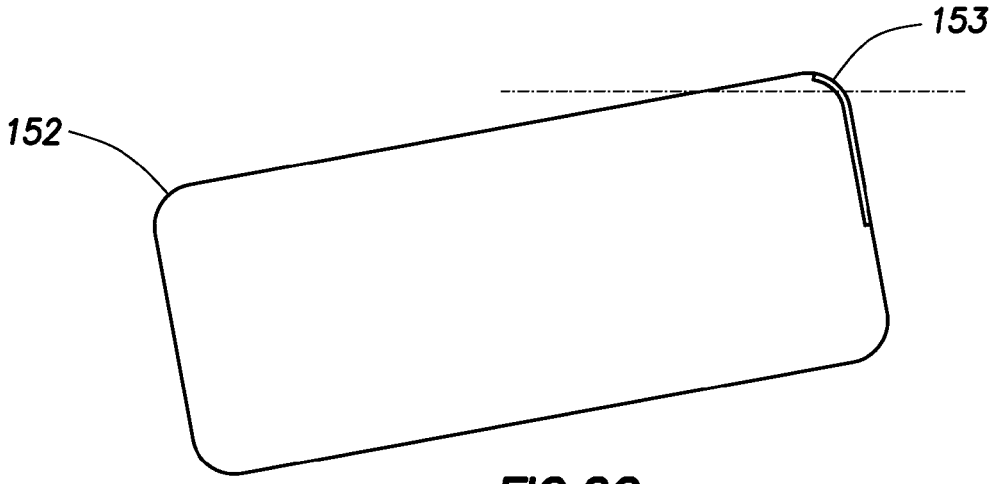
FIG. 2C illustrates a cutting edge of a cutter according to an embodiment of the disclosure.
Figure 2D:
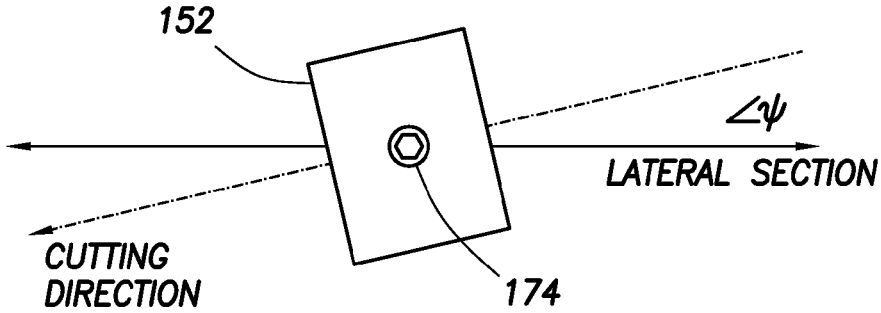
FIG. 2D illustrates a top view of a cutter position according to an embodiment of the disclosure.

With reference now to FIG. 2B, in an embodiment the first cutters 152 may be positioned by the machined recesses to make an angle θ with the longitudinal axis of the cutting tool 102. With reference now to FIG. 2C, in an embodiment, the first cutters 152 may be positioned by the machined recesses to cuttingly engage along a cutting edge 153, where the cutting edge 153 is only a portion of an extended edge of the first cutters 152. With reference now to FIG. 2D, in an embodiment, the first cutters 152 may be positioned by the machined recesses at an angle ψ with respect to a lateral section of the cutting tool 102 to face squarely into a helical direction of travel as the cutting tool 102 works. In an embodiment, the first cutters 152 may be removeably attached to the tool body 101, for example, by one or more bolts 174 or by other removable attachment hardware. In another embodiment, however, the first cutters 152 may be non-removeably attached to the tool body 101.

In an embodiment, two ports defined by the tool body 101 proximate to the cutting edges of the first cutters 152*a* and 152*b* and having communication with the interior cavity of the tool body 101 provide circulation fluid under pressure during cutting operation to both cool the cutting edges of the first cutters 152 and to promote predictable breaking off cutting chips in a size effective to promote ready evacuation of cuttings.

The cutting edges of the first cutters 152 define a cutting diameter that is larger than the cutting diameter defined by the spade cutter 150. In some contexts, the first cutters 152 may be said to provide a milling type of cutting functionality. In an embodiment, when worn, the first cutters 152 may be first removed, rotated or flipped to present a fresh, unworn cutting edge, and then reattached to the tool body 101 by attachment hardware by unskilled and/or semi-skilled workers in the field or in the shop. In an embodiment, when all cutting edges are worn beyond serviceability, the first cutters 152 may be retired from service and replaced by unskilled and/or semi-skilled workers in the field or in the shop. Alternatively, in an embodiment, the first cutters 152 may be braised to the tool body 101 and may be removed and replaced in a shop environment where appropriate refurbishing tooling is available.

With reference now again to FIG. 2A, in an embodiment, the cutting tool 102 further comprises a second pair of cutters 154 and a third pair of cutters 156 that are substantially similar to the first cutters 152, with the exception that the cutting diameter defined by the second cutters 154 is larger than the cutting diameter defined by the first cutters 152, and the cutting diameter defined by the third cutters 156 is larger than the cutting diameter defined by the second cutters 154. In some contexts, the second cutters 154 and the third cutters 156 may be said to provide a milling type of cutting functionality The second cutters 154 are aft of and offset from the first cutters 152 rotated by about 45 degrees rotationally from the first cutters 152 with reference to the centerline of the tool body 101. The third cutters 156 are aft of and offset from the second cutters 154 rotated by about 45 degrees rotationally from the second cutters 154 with reference to the centerline of the tool body 101.

In an embodiment, the cutting tool 102 further comprises a pair of back-up cutters 158. In an embodiment, the backup cutters 158 are aft of and offset from the associated third cutters 156 by about 45 degrees rotationally from the third cutters 156 with reference to the centerline of the tool body 101. In an embodiment, the backup cutters 158 are supported in machined recesses similar to those that support the first cutters 152.

The backup cutters 158 may be attached to the tool body 101 in a manner similar to the first cutters 152. The backup cutters 158 have a shape and composition similar to the first cutters 152. Unlike the first cutters 152, however, the backup cutters 158 are positioned by the machined recesses to present substantially all of the edge of their cutting face as a cutting edge, for example by reducing the angle θ at which the machined recesses angle inwards at their aft end towards the centerline of the tool body 101. The backup cutters 158 may be said to cuttingly engage along substantially all of an extended edge after the associated third cutters 156 have worn down below an effective cutting diameter. The cutting diameter defined by the backup cutters 158 is slightly less than the cutting diameter defined by the third cutters 156 when the third cutters 156 are unworn. The backup cutters 158 are designed to assume the cutting load when the cutting edges of the third cutters 156 have worn down below an effective cutting diameter, to reduce the likelihood of the cutting tool 102 becoming stuck or blocked. In an embodiment, it is desirable that the backup cutters 158 have a cutting diameter that is slightly larger than the diameter of a plurality of bearing pads to be discussed hereinafter.

In an embodiment, two ports are defined by the tool body 101 proximate to the cutting edges of the second cutters 154, two ports are defined by the tool body 101 proximate to the third cutters 156, and two ports are defined by the tool body 101 proximate to the cutting edges of the first backup cutters 158 and have communication with the interior cavity of the tool body 101. The ports provide circulation fluid under pressure during cutting operation to both cool the cutting edges of the second cutters 154, the third cutters 156, and the first backup cutters 158 and to promote predictable breaking off cutting chips in a size effective to promote ready evacuation of cuttings. One of the ports 157 is illustrated in FIG. 2A. In an embodiment, the spade cutter 150 defines a cutting diameter of about 2.0 inches, the first cutters 152 define a cutting diameter of about 2.5 inches, the second cutters 154 define a cutting diameter of about 3.0 inches, and the third cutters 156 define a cutting diameter of about 3.5 inches. The backup cutters 158 define a cutting diameter of about 3.5 inches. In another, embodiment, however, the spade cutter 150, the first cutters 152, the second cutters 154, and the third cutters 156 may define different cutting diameters.

The different cutting diameters defined by the spade cutter 150, the first cutters 152, the second cutters 154, and the third cutters 156, and other cutters to be described hereinafter define a step cutter. Additionally, in another embodiment, either more cutters or fewer cutters may be employed by the cutting tool 102. In combination with the present disclosure, the number of cutters may be determined by one of ordinary skill in the art based on a desired maximum rate of cutting and/or the dimensions of cutter components. For example, a cutting tool 102 having the same maximum cutting diameter but a greater number of cutting steps may potentially be operated at a higher cutting rate while not exceeding a desired cutting load on the cutters, because the greater cutting load may be distributed over a larger number of cutters.

In an embodiment, the cutting tool 102 may further comprise a plurality of bearing pads 160. In an embodiment, the bearing pads 160 are supported within machined recesses with drilled out corners and are removeably attached to the tool body 101, for example using screws, bolts, or other removable attachment hardware. In an embodiment, the bearing pads 160 are secured by attachment hardware at holes in the bearing pads 160 that are countersunk on the external face of the bearing pads 160. Alternatively, in another embodiment, the bearing pads 160 may be non-removeably attached to the tool body 101. When secured in place, the bearing pads 160 protrude above the surface of the tool body 101 and present a slightly humped shape, with a high point in about the center of the bearing pads 160. In an embodiment, the bearing pads 160 may have a tungsten carbide composition, but in other embodiments the bearing pads 160 may be composed of some other rugged and durable material suitable to bearing operations.

In an embodiment, the plurality of bearing pads 160 may be disposed in pairs consisting of bearing pads 160 that are opposite each other across the centerline of the tool body 101, each pair of bearing pads 160 offset from the adjacent pair of bearing pads 160 by about 45 degrees rotationally with reference to the centerline of the tool body 101. The bearing diameter defined by the pairs of bearing pads 160 as the cutting tool 102 rotates and works is substantially equal for each pair of bearing pads 160. In an embodiment, the bearing diameter defined by the pairs of bearing pads 160 is about 3.495 inches, but in other embodiments the bearing pads 160 may define a different bearing diameter. In an embodiment, seven pairs of bearing pads 160 (fourteen bearing pads 160) are employed, but in other embodiments different numbers of pairs of bearing pads 160 may be employed.

The bearing pads 160 are non-cutting components and define a non-cutting stabilizing portion 107 of the tool body 101. In another embodiment, the bearing pads 160 may be absent and the non-cutting stabilizing portion 107 of the tool body 101 may be treated with 'hard banding': harder material, for example tungsten carbide, welded or otherwise affixed to the tool body 101. In another embodiment, the bearing pads 160 may be absent and the non-cutting stabilizing portion 107 of the tool body 101 may be a surface hardened section of the tool body 101, for example surface hardened by a case hardening process such as a boriding process, a carburizing process, a nitriding process, and/or other process. The effect of the non-cutting stabilizing portion 107 of the tool body 101 is to stabilize and to radially support the cutting tool 102, first when drilling through the bushing 104, when drilling through the casing wall to form the window in the casing, and later when drilling into the formation proximate to the window in the casing. In some contexts, the non-cutting stabilizing portion 107 of the tool body 101 may be said to radially support the cutting tool 102 in 360 degrees, because the cutters 150, 152, 154, 156 (which may also be referred to as cutters forward of the non-cutting stabilizing portion 107 of the tool body 101) and the non-cutting stabilizing portion 107 of the tool body 101 are radially contained within the bushing 104 in the run-in state of the cutting tool system 100.

In an embodiment, the non-cutting stabilizing portion 107 may comprise about 10% of the total length of the cutting tool 102. In another embodiment, the non-cutting stabilizing portion 107 may comprise about 20% of the total length of the cutting tool 102. In another embodiment, the non-cutting stabilizing portion 107 may comprises about 30% of the total length of the cutting tool 102. In another embodiment, the non-cutting stabilizing portion 107 may comprise about 40% of the total length of the cutting tool 102. In another embodiment, the non-cutting stabilizing portion 107 may comprise about 50% of the total length of the cutting tool 102.

In an embodiment, the first cavity 120 of the bushing 104 has an inside diameter of about 3.505 inches and the bearing diameter defined by the pairs of bearing pads 160 is about 3.495 inches, leaving a clearance between the first cavity 120 and the bearing pads 160 of less than about 10 thousandths (0.010) inches. In another embodiment, however, the dimensions of the inside diameter of the first cavity 120 may be about 3.520 inches, leaving a clearance between the first cavity 120 and the bearing pads 160 of less than about 25 thousands (0.025) inches. In another embodiment, the clearance between the first cavity 120 and the bearing pads 160 is effective to provide room to admit the cutters 152, 154, 154 and the bearing pads 160 into the first cavity 120 as well as to provide desirable lateral support to the cutting tool 102 during cutting operation. In an embodiment, as the cutting tool 102 cuts through the bushing 104, the spade cutter 150, the first cutters 152, the second cutters 154, and the third cutters 156 cut an about 3.5 inch diameter hole, leaving a clearance between the bearing pads 160 and the cut-out hole of about 5 thousandths (0.005) inches.

In some contexts the first cavity 120 in the bushing 104 may be said to radially support the cutting tool 102 and/or the non-cutting stabilizing portion 107 of the tool body 101 in 360 degrees, at least during initial cutting operation. In an embodiment, the maximum cutting diameter of the cutters forward of the non-cutting stabilizing portion 107 of the tool body 101, for example the cutting diameter defined by the third cutters 106, may less than about 1.1 times the outside diameter defined by the non-cutting stabilizing portion 107 of the tool body 101. In another embodiment, the maximum cutting diameter of the cutters forward of the non-cutting stabilizing portion 107 of the tool body 101 may be less than about 1.05 times the outside diameter defined by the non-cutting stabilizing portion 107 of the tool body 101. In another embodiment, the maximum cutting diameter of the cutters forward of the non-cutting stabilizing portion 107 of the tool body 101 may be less than about 1.02 times the outside diameter defined by the non-cutting stabilizing portion 107 of the tool body 101. In another embodiment, the maximum cutting diameter of the cutters forward of the non-cutting stabilizing portion 107 of the tool body 101 may be less than about 1.01 times the outside diameter defined by the non-cutting stabilizing portion 107 of the tool body 101. It will be appreciated that the smaller the ratio of the maximum cutting diameter of the cutters forward of the non-cutting stabilizing portion 107 of the tool body 101 to the outside diameter defined by the non-cutting stabilizing portion 107 of the tool body 101, the greater the stabilization effect. On the other hand, the smaller the ratio of the maximum cutting diameter of the cutters forward of the non-cutting stabilizing portion 107 of the tool body 101 to the outside diameter defined by the non-cutting stabilizing portion 107 of the tool body 101, the less tolerance for machining error in fabricating the first cavity 120 in the bushing 104 and the cutting tool 102. In combination with the present disclosure, one of ordinary skill in the art will be able to determine a suitable ratio of the maximum cutting diameter of the cutters forward of the non-cutting stabilizing portion 107 of the tool body 101 to the outside diameter defined by the non-cutting stabilizing portion 107 of the tool body 101.

One skilled in the art will readily appreciate the high level of radial support and stabilization that is provided by the non-cutting stabilizing portion 107 of the tool body 101. The stabilization provided by the non-cutting stabilizing portion 107 of the tool body 101 prevents the cutting tool 102 walking undesirably in the wellbore. The stabilization provided by the non-cutting stabilizing portion 107 of the tool body 101 promotes the cutting tool 102 continuing to cut through the bushing 104, through the casing, and through the formation along a cutting path in accordance with the trajectory defined by and determined by the first cavity 120 defined by the bushing 104. The stabilization provided by the non-cutting stabilizing portion 107 of the tool body 101 discourages deviations of the cutting path from the trajectory defined by the first cavity 120, for example discouraging yawing motion, rolling motion, pitching motion off of the trajectory defined by the first cavity 120. The stabilization of the cutting tool 102 promotes precise and controlled cutting engagement of the cutters 150, 152, 154, 156, and other cutters with first the bushing 104 and later the casing and the formation with a predictable and preferred alignment and load. The precise positioning and stabilization of the cutting tool 102 enables refinement and elaboration of several design features of the cutting tool system 100, for example the irregularly shaped cutting face to control a desirable cutting chip size effective for ready evacuation of cuttings from the cutting interface and wellbore, for example the selection of the composition of the bushing 104 to promote a desirable cutting chip size when the cutting tool 102 cuts through the bushing 104, for example the positioning of the ports 157 proximate to each of the cutting edges. For the most part, incorporation of these subtle design features would be irrelevant in the less controlled cutting systems of the prior art.

Figure 2E:
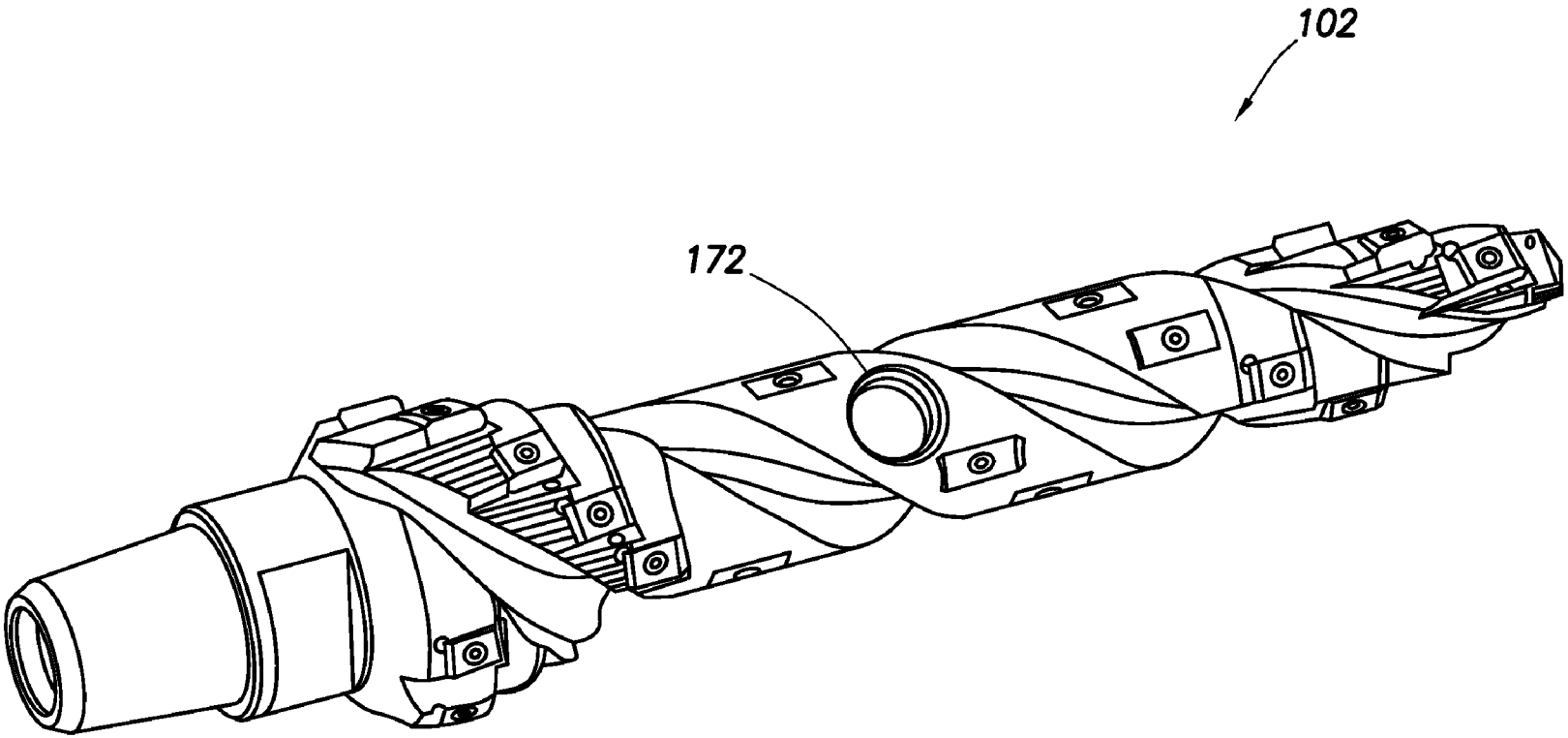
FIG. 2E illustrates a second view of the cutting tool according to an embodiment of the disclosure.

A recess 172, shown in FIG. 2E, is machined in a land of the tool body 101, for example, between bearing pads 160 in the middle non-cutting portion of the cutting tool 102. The recess 172 receives the shear pin 122 for coupling and aligning the cutting tool 102 to the bushing 104 during run-in. The shear pin 122 may be spring loaded to deploy into a mating recess in the interior of the bushing 104 as the cutting tool 102 is assembled with the bushing 104. The shear pin 122 may be composed of any suitable material. A plurality of shear pins 122 may be employed. Alternatively, the cutting tool 102 and the bushing 104 may be coupled and aligned during run-in by use of one or more retainers engaged by corresponding retainer recesses in each of the tool body 101 and the bushing 104, wherein the retainers are designed to shear under a predetermined loading. The shear pin 122 and/or the retainers likewise may be sheared by pulling up on the cutting tool 102 and/or rotating the cutting tool 102 relative to the bushing 104, for example the bushing 104 when anchored or otherwise secured to the casing.

In an embodiment, a plurality of pairs of additional cutters 162 are provided to cut progressively wider diameter cuts out of first the bushing 104, then the casing, then the formation proximate to the window cut through the casing. In an embodiment, each additional pair of cutters 162 may widen the cutting diameter by about 0.5 inches. In an embodiment, the additional pairs of cutters 162 may be located substantially similarly to the first cutters 152 in machined recesses, may be positioned by the machined recesses at an angle to present a cutting edge that is a portion of an edge of the additional cutters 162, may be positioned by the machined recesses at an angle to face squarely into a helical direction of travel as the cutting tool 102 works, and may be associated with ports defined by the tool body 101 and communicating with the interior cavity of the tool body 101 that provide circulation fluid under pressure during cutting operations.

As with the first cutters 152, the second cutters 154, and the third cutters 156, likewise, the additional cutters 162 may be disposed in complementary pairs offset from each other by about 180 degrees rotationally around the longitudinal axis of the tool body 101. In an embodiment, the additional cutters 162 may be similar in composition and in shape to the first cutters 152 and may be attached to the tool body 101 similarly to the first cutters 152. In some contexts, the additional cutters 162 may be said to provide a milling type of cutting functionality. In an embodiment, the additional cutters 162 similarly to the first cutters 152 may be field maintainable by unskilled and/or semi-skilled workers by removing, flipping or rotating, and reattaching or by removing, replacing, and attaching. In another embodiment, however, the additional cutters 162 may be non-removeable.

In an embodiment, a pair of finishing cutters 166 may be provided to cut the finishing and widest diameter cut out of first the bushing 104, then the casing, then the formation proximate to the window. In an embodiment, the finishing cutters 166 may widen the cutting diameter by about 0.5 inches. In an embodiment, the finishing cutters 166 may be located substantially similarly to the first cutters 152 in a machined recess, may be positioned by the machined recess at an angle to present a cutting edge that is a portion of an edge of the finishing cutters 166, may be positioned by the machined recess at an angle to face squarely into a helical direction of travel as the cutting tool 102 works, and may be associated with a port defined by the tool body 101 and communicating with the interior cavity of the tool body 101 that provides circulation fluid under pressure during cutting operations.

In an embodiment, the finishing cutters 166 may be similar in composition and in shape to the first cutters 152 and may be attached to the tool body 101 similarly to the first cutters 152. In some contexts, the finishing cutters 166 may be said to provide a milling type of cutting functionality. In an embodiment, the finishing cutters 166, similarly to the first cutters 152, may be field maintainable by unskilled and/or semi-skilled workers by removing, flipping or rotating, and reattaching or by removing, replacing, and attaching. Alternatively, in another embodiment, the finishing cutters 166 may be non-removeable, for example the finishing cutters 166 may be braised to the tool body 101 and may be refurbished in a shop where specialized equipment is available. The finishing cutters 166, the additional cutters 162, the spade cutter 150, the first cutters 152, the second cutters 154, and the third cutters 156 may be said to define a step cutter.

In an embodiment, a pair of rate limiting cutters 168 may be provided to limit the maximum cutting rate of the cutting tool 102 as well as to function as a backup cutter to the finishing cutters 166. In some contexts, the rate limiting cutters 168 maybe referred to as rate limiting components. The rate limiting cutters 168 may assume the cutting load of the finishing cutters 166 if the finishing cutters 166 wear excessively. The rate limiting cutters 168 are proximate to and in front of (with respect to the direction of rotation of the cutting tool 102 when engaged in cutting operation) the finishing cutters 166. The rate limiting cutters 168 are set back (up hole) longitudinally from the finishing cutters 166 by a distance effective to provide the desired rate limitation. The set back distance corresponds substantially to the maximum cutting progress allowed during one half rotation of the cutting tool 102. When the finishing cutters 166 cut at the maximum allowed rate, the rate limiting cutters 168, having a different alignment from the finishing cutters 166, engage and slide along the cut made by the finishing cutters 166 and retard further cutting until the cutting tool 102 revolves further.

The cut made by the finishing cutters 166 can be visualized as an inclined plane that is wrapped around to create one rotation, such as one rotation of a circular stairway. At maximum cutting rate, the rate limiting cutters 168 slide along the rotated inclined plane blocking more rapid cutting by the finishing cutters 166. In an embodiment, the rate limiting cutters 168 may be set back from the finishing cutters 166 by a distance of 10 thousandths (0.010) inch, thereby limiting the maximum cutting rate of the cutting tool 102 to about 20 thousandths (0.020) inch per revolution. If the cutting tool 102 is turned at 100 revolutions per minute (RPM), this limitation corresponds to a maximum cutting rate of about 2 inches per minute. In another embodiment, the rate limiting cutters 168 may be set back from the finishing cutters 166 by a different distance. In another embodiment, another rate limiting component may be used in place of the rate limiting cutters 166. For example, a shoulder, a bead, or another protrusion may be coupled to or defined by the tool body 101, located set back from the finishing cutters 166 to limit the rate of cutting of the finishing cutters 166. In an embodiment, the rate limiting component may comprise tungsten carbide and may be braised to the tool body 101.

In an embodiment, the rate limiting cutters 168 may be located in machined recesses, may be positioned by the machined recesses at an angle to retard cutting, and may each be associated with a port defined by the tool body 101 and communicating with the interior cavity of the tool body 101 that provides circulation fluid under pressure. In an embodiment, the rate limiting cutters 168 may be similar in composition and in shape to the first cutters 152 and may be attached to the tool body 101 similarly to the first cutters 152. In an embodiment, the rate limiting cutters 168, similarly to the first cutters 152, may be field maintainable by unskilled and/or semi-skilled workers by removing, flipping or rotating, and reattaching or by removing, replacing, and attaching. Alternatively, in another embodiment, the rate limiting cutters 168 may be non-removeably attached to the tool body 101, for example the rate limiting cutters 168 may be braised to the tool body 101 and may be refurbished in a shop where specialized equipment is available. A wrench shoulder 170 may be defined by the tool body 101 for coupling the cutting tool 102 to the work string.

Figure 3A:
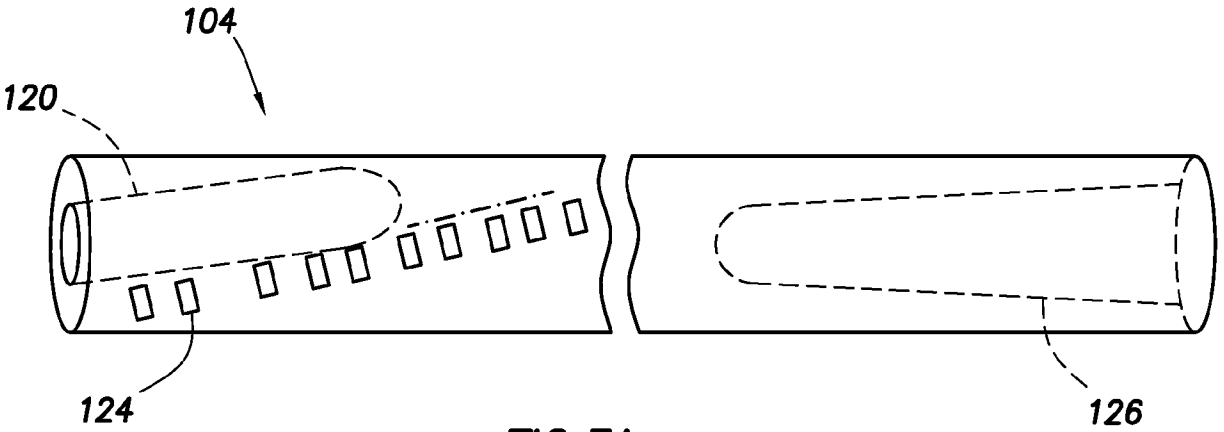
FIG. 3A illustrates a first view of a bushing according to an embodiment of the disclosure.

Turning now to FIG. 3A, further details of the bushing 104 are described. In an embodiment, one or more cut-out slots may be defined by the bushing 104 to receive and protect the cutters 166, 168 from impact forces during shearing of the shear pin 122 and/or retainer. In an embodiment, impact absorbing material and/or buffer material such as leather, plastic, or elastomer may be provided between the cutting tool 102 and the bushing 104 to absorb and/or dissipate the forces released during shearing. In an embodiment, the bushing 104 may comprise a plurality of hard pads 124 located just outside the cutting trajectory of the cutting tool 102. In an embodiment, the hard pads 124 may have a tungsten carbide composition, but in other embodiments the hard pads 124 may be composed of some other rugged and durable material effective for resisting wear down during lateral wellbore working operations. After the window is cut in the casing wall by the cutting tool 102 and the cutting tool 102 is removed, a work string may subsequently be run-in through the window to work in the lateral wellbore, for example to drill out the lateral wellbore. This extended rotating of the work string as the lateral wellbore is worked, for example a work string at least partially treated with 'hardbanding,' may wear down the metal of the bushing 104. When the metal of the bushing 104 is worn down far enough, the work string may begin to contact the hard pads 124 which are designed to withstand the wearing effect of the rotating work string.

Figure 3B:
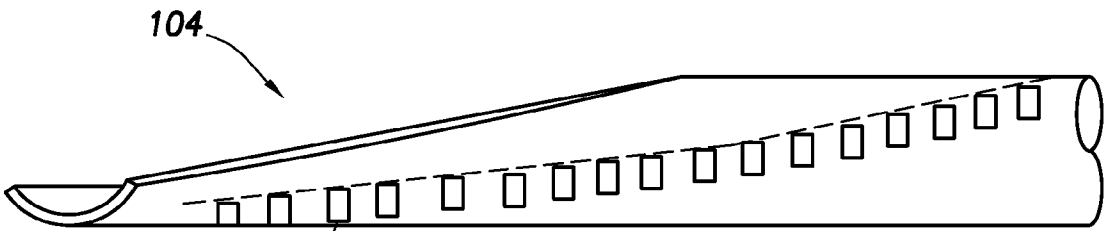
FIG. 3B illustrates a second view of the bushing according to an embodiment of the disclosure.

Turning now to FIG. 3B, further details of the bushing 104 are described. After the cutting tool 102 has cut through the bushing 104, through the casing, and into the formation proximate to the window in the casing, a portion of the upper end of the bushing 104 will have been removed, leaving the remainder of the bushing 104 looking substantially as depicted in FIG. 3B. In an embodiment, after having served the function of providing enhanced stabilization and/or radial support to the cutting tool 102 during cutting operations, the drilled out bushing 104 of FIG. 3B may remain in the wellbore to provide the customary function of a whipstock. In an embodiment, the third cavity 126 defined by the bushing 104 may provide a mechanism for removing the bushing 104 from the wellbore after completion of operations in the lateral wellbore.

Figure 4:
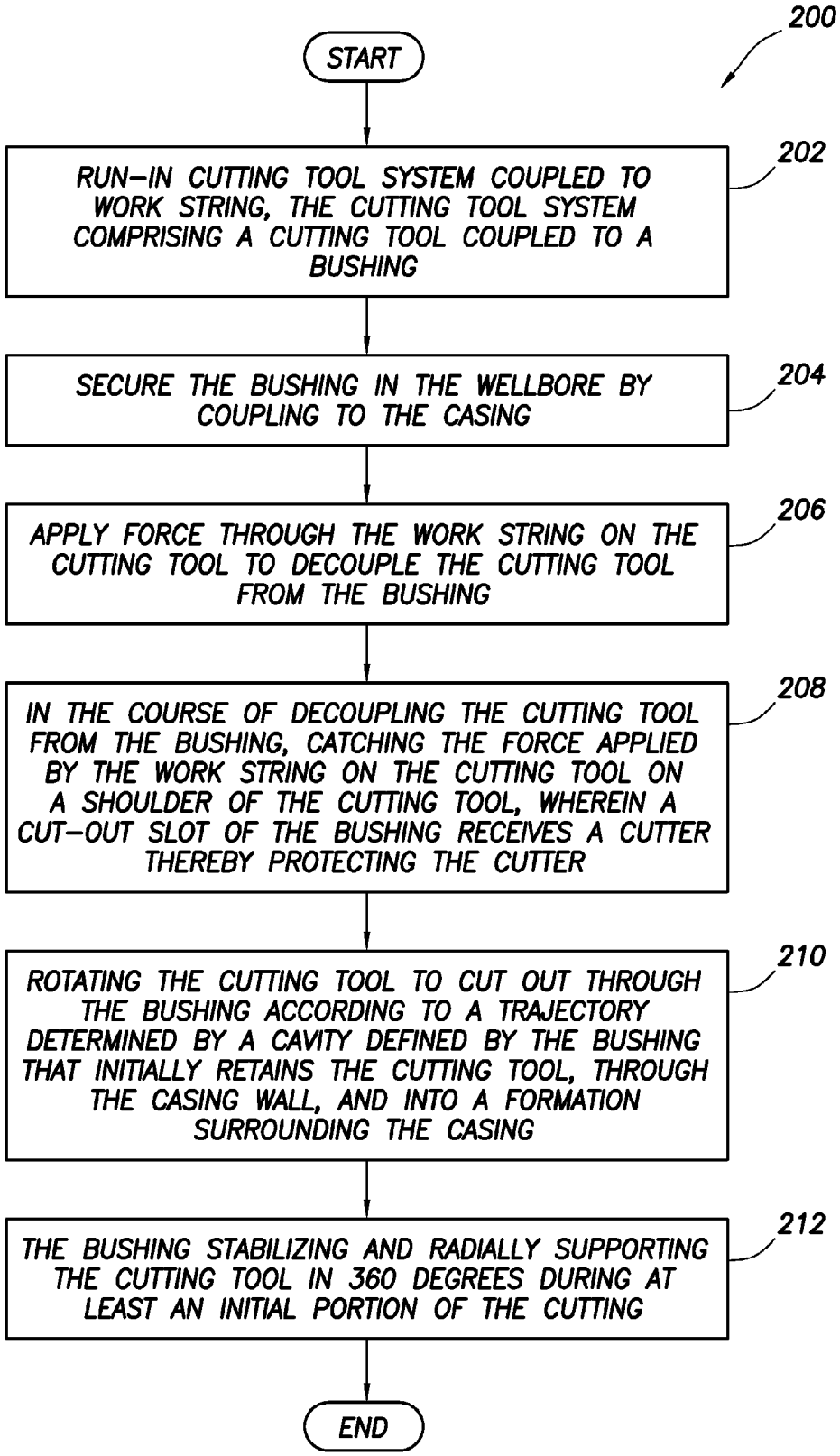
FIG. 4 illustrates a method of cutting a window in a casing wall according to an embodiment of the disclosure.

Turning now to FIG. 4, a method 200 of using the cutting tool system 100 is described. At block 202, the cutting tool system 100 is run into a wellbore coupled to a work string. The wellbore is cased with any of a variety of tubular casing known to those skilled in the art. In an embodiment, the wellbore may be cased with any of American Petroleum Institute (API) L-80 steel tubing, 13% chrome steel tubing, API P-110 steel tubing, and other tubing. The cutting tool 102 may be coupled to the bushing 104 at least by the shear pin 122 or a plurality of shear pins 122. In another embodiment, the cutting tool 102 may be coupled to the bushing 104 by another mechanism, for example by an adhesive or other coupling mechanism. At block 204, the bushing 104 is secured in wellbore by coupling to the casing. In an embodiment, the bushing 104 may be secured by one of a latch coupling, a packer, a bottom set, an anchor, and other known coupling mechanisms.

At block 206, force is applied directed into the wellbore by the work string on the cutting tool 102 to cause the shear pin 122 to shear, thereby decoupling the cutting tool 102 from the bushing 104. Because no rotational motion is imparted to the work string during this procedure, it is anticipated that after the shearing the cutting tool 102 will move along the axis of the first cavity 120 without substantial rotational movement. In some embodiments, the work string may be a mile or longer in length and may exhibit distinct spring effects. Alternatively, rotational force and/or force directed out of the wellbore (upwards) may be applied to cutting tool 102 to decouple the cutting tool from the bushing 104. At block 208, the inward motion of the cutting tool 102 freed from the shear pin 122 is arrested at a shoulder of the cutting tool 102 by the bushing 104, wherein a slot defined by the bushing 104 is aligned to receive at least one of the cutters 166, 168 thereby sparing the cutters 166, 168 from substantial impact forces and possible damage. In an embodiment, buffer material and/or impact absorption material may be placed between the cutting tool 102 and the bushing 104 to absorb and/or dissipate impact forces.

At block 210, the cutting tool 102 is rotated to cut out the cut-out slot, to cut through the bushing according to a trajectory defined by and/or determined by the first cavity 120, to cut through the casing wall forming a window therethrough, and to cut into the formation proximate the casing. The maximum cutting rate of the cutting tool 102 is limited by the rate limiting cutters 168, for example limited to a maximum cutting of about 20 thousandths (0.020) of an inch per revolution. At block 212, the bushing 104 provides substantial stabilization and radial support to the cutting tool 102 in 360 degrees as it operates cutting through the bushing 104 and through the casing wall.

After the window is cut through the casing wall, the cutting tool 102 is removed from the wellbore while the bushing 104 may be left in the wellbore. Thereafter, tools for working in the lateral wellbore, such as a drill bit, may be attached to the work string, the work string may be run-in, the tool may be directed through the window by the bushing 104, and work in the lateral wellbore may proceed. After completion of work in the lateral wellbore, the bushing 104 may be removed by a variety of different methods. A washover tool may be used to pass over the outside of the bushing 104 and cut through hardware, such as brass pins, securing the bushing 104 in the casing. A tap may be threaded into the third cavity 126 and the bushing 104 withdrawn. Yet other methods for removing the bushing 104 from the wellbore, including use of a die collar or use of a hook. For example, a hook slot may be machined into the bushing 104 to receive a hook to withdraw the bushing 104.

Outside the wellbore, the cutting tool 102 may be maintained by removing one or more cutters 150, 152, 154, 156, 162, 166 and replacing and/or repositioning to expose an unworn cutting edge. The maintenance may be performed by unskilled or semi-skilled workers proximate to the location of a wellbore or at a shop. The bearing pads 160 may be maintained by removing and replacing by unskilled or semi-skilled workers proximate to the location of a wellbore or at a shop. In an embodiment, cutters 150, 152, 154, 156, 162, 168 and/or bearing pads 160 may be removed using a commonly available torque wrench and appropriate socket heads.

It is contemplated that the cutting tool system 100 taught by the present disclosure can provide more rapid and efficient cutting operations, for example cutting a window through a casing wall to promote drilling of a lateral wellbore. The high stabilization and radial support provided by the mating of the first cavity 120 of the bushing 104 and the non-cutting stabilization portion 107 of the tool body 101 may enable more precise and substantially improved alignment of cutting edges to the casing wall. The improved cutting provided by the cutting tool system 100 may be especially appreciated when cutting windows through extra hard steel, such as 13% chrome steel tubing and/or API P-110 steel tubing. Further, the non-cutting stabilizing portion 107 of the tool body 101 continues to provide substantially improved lateral stability as cutting continues outside of the casing into the formation proximate to the window in the casing wall. The initial costs of fabricating the cutting tool system 100 are anticipated to be less than those of the prior art cutting tools featuring cutters braised to the tool body by craftsmen. Further, the ease of maintenance of the cutting tool 102 may provide significant cost savings with reference to the prior art cutting tools featuring cutters braised to the tool body by craftsmen.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An oilfield downhole cutting tool, comprising:

a tool body comprising a non-cutting stabilizing section;

a plurality of first cutters coupled to the tool body forward of the non-cutting stabilizing section, wherein a maximum cutting diameter defined by the first cutters is less than 1.1 times a diameter defined by the non-cutting stabilizing section;

a plurality of second cutters located aft of the non-cutting stabilizing section; and a cutting rate limiting component coupled to the tool body, wherein the cutting rate limiting component comprises one of a rate limiting cutter, a shoulder, a bead, or a protrusion that is set back longitudinally with respect to the tool body from the second cutters by a distance that limits the maximum cutting rate of the cutting tool to a maximum longitudinal distance per revolution of the cutting tool.

2. The oilfield downhole cutting tool of claim 1, wherein the maximum cutting diameter defined by the first cutters is less than 1.02 times the diameter defined by the non-cutting stabilizing section.

3. The oilfield downhole cutting tool of claim 1, wherein the first cutters are removeably coupled to the tool body.

4. The oilfield downhole cutting tool of claim 1, wherein the first cutters comprise a spade cutter removeably coupled to the tool body surmounting a forward end of the tool body.

5. The oilfield downhole cutting tool of claim 4, wherein the spade cutter has a groove inwards from the cutting edge of the spade cutter.

6. The oilfield downhole cutting tool of claim 1, wherein the first cutters are comprised of tungsten carbide.

7. The oilfield downhole cutting tool of claim 1, wherein the first cutters are coupled to the tool body in machined recesses.

8. The oilfield downhole cutting tool of claim 1, further comprising a plurality of bearing pads removeably coupled to the non-cutting stabilizing section of the tool body.

9. The oilfield downhole cutting tool of claim 1, wherein the tool body further comprises a helical flute.

10. An oilfield downhole cutting tool system, comprising:

a cutting tool comprising a tool body comprising a non-cutting stabilizing section, a plurality of machined recesses, and a plurality of cutters removably coupled to the tool body with attachment hardware in the machined recesses; and a bushing defining a closed cavity and the bushing defining a cutting trajectory of the cutting tool, wherein in a run-in state of the system the closed cavity receives at least a portion of the cutting tool, and wherein in a cutting state of the system the non-cutting stabilizing section is configured to turn in the same direction and at substantially the same rate as the cutters.

11. The oilfield downhole cutting tool system of claim 10, wherein the bushing radially stabilizes the cutting tool in 360 degrees during initial cutting operation.

12. The oilfield downhole cutting tool system of claim 11, wherein the bushing radially stabilizes the cutting tool via contact with the non-cutting stabilizing section of the cutting tool.

13. The oilfield downhole cutting tool system of claim 10, wherein the cutting tool partially cuts out the bushing during cutting operation.

14. The oilfield downhole cutting tool system of claim 10, wherein the bushing serves to guide tools through a window cut by the cutting tool in a casing of a wellbore, after removal of the cutting tool from the wellbore.

15. A method of cutting a hole in a wellbore casing, comprising:

running a cutting tool system into a wellbore, the cutting tool system comprising a cutting tool coupled to a bushing, the cutting tool received by a closed cavity defined by the bushing;

rotating the cutting tool to cut through the bushing and to cut the hole through the casing, the cutting following a trajectory determined by the closed cavity;

removing attachment hardware attaching a cutter to the cutting tool;

detaching the cutter of the cutting tool;

one of rotating or flipping the cutter; and reattaching the same cutter to the cutting tool with the attachment hardware to engage a different cutting edge of the cutter.

16. The method of cutting a hole in a wellbore casing of claim 15, further comprising the bushing radially stabilizing the cutting tool in 360 degrees during at least an initial portion of the cutting.

17. The method of claim 15, wherein the clearance between the bushing and a non-cutting stabilizing portion of the cutting tool is less than about 20 thousandths of an inch (0.020 inches) in a run-in state of the cutting tool system.

18. The method of claim 15, further comprising the cutting tool automatically limiting the rate of cutting through the bushing.

19. The method of claim 15, further comprising:

removing the cutting tool from the wellbore while leaving the bushing in the wellbore; and the bushing guiding a completion tool through the hole in the wellbore casing.

20. The method of claim 15, wherein the cutting tool cuts with both a drilling action and a milling action.

* * * * *